US006375427B1

(12) United States Patent
Williams et al.

(10) Patent No.: US 6,375,427 B1
(45) Date of Patent: Apr. 23, 2002

(54) ENGINE COOLING FAN HAVING SUPPORTING VANES

(75) Inventors: Eugene E. Williams, Frankfort; Jonathan B. Stagg, Greencastle, both of IN (US)

(73) Assignee: BorgWarner Inc., Troy, MI (US)

( * ) Notice: Subject to any disclaimer, the term of this patent is extended or adjusted under 35 U.S.C. 154(b) by 0 days.

(21) Appl. No.: 09/549,436

(22) Filed: Apr. 14, 2000

(51) Int. Cl.[7] ..... F04D 29/00

(52) U.S. Cl. ..... 416/169 A; 416/175; 416/203; 416/DIG. 5

(58) Field of Search ..... 416/169 A, 175, 416/190, 236 R, 244 R, DIG. 5, 203

(56) References Cited

U.S. PATENT DOCUMENTS

| | | | | |
|---|---|---|---|---|
| 1,066,988 A | * | 7/1913 | Boutwell | 416/236 R |
| 3,842,902 A | | 10/1974 | Postesny | |
| 4,128,363 A | * | 12/1978 | Fujikake et al. | 416/236 A |
| 4,189,281 A | | 2/1980 | Katagiri et al. | |
| 4,222,710 A | | 9/1980 | Katagiri et al. | |
| 4,265,596 A | | 5/1981 | Katagiri et al. | |
| 4,406,581 A | | 9/1983 | Robb et al. | |
| 4,566,852 A | | 1/1986 | Hauser | |
| 5,193,983 A | * | 3/1993 | Shyu | 416/236 A |
| 5,273,400 A | * | 12/1993 | Amr | 416/189 |
| 5,645,401 A | * | 7/1997 | Martin et al. | 416/169 A |
| 6,010,305 A | * | 1/2000 | Hauser | 416/169 A |
| 6,241,474 B1 | * | 6/2001 | Alizadeh et al. | 416/189 |

FOREIGN PATENT DOCUMENTS

| | | |
|---|---|---|
| EP | 0 515 839 | 12/1992 |
| FR | 1 518 482 A | 7/1968 |
| JP | 5 806 6000 | 4/1983 |

* cited by examiner

*Primary Examiner*—Edward K. Look
*Assistant Examiner*—Ninh Nguyen
(74) *Attorney, Agent, or Firm*—Greg Dziegielewski

(57) ABSTRACT

An engine cooling system include a ring-type cooling fan (10) that includes a central hub (12), a plurality of blades (11) projecting radially from the hub (12) and an outer circumferential ring (15) connected to the blade tips (17). In one aspect of the invention, the outer ring (15) includes a flared rim (28) at the outlet side (10*b*) of the fan (10) that improves the stackability and stability of multiple fans. In another aspect of the invention, each of the blades (11) includes a support vane (30) defined on the rear face (25) of the blade (11). The support vane (30) is curved to follow the curvature of the airflow (F) across the back (25) of the fan blades (11). Each support vane (30) originates at the blade root (19) and terminates at the trailing edge (11*b*) of the blade in the first half of the blade length. The support vanes (30) provide first mode stiffness for the fan (10). In certain embodiments, a support ring (35) is defined at the central hub (12) inboard of the support vanes (30). A vane support superstructure (37) is configured between the support vanes (30) and the support ring (35) to react the aerodynamic loads experienced by the support vanes (30). A further support superstructure (37) can be configured between the support ring (35) and the central hub (12). Other features of the invention provide a stress-reducing blend region (20) between the blade tips (17) and the flared rim (28) of the outer ring (15), and an improved blade geometry.

17 Claims, 8 Drawing Sheets

ENGINE COOLING FAN HAVING SUPPORTING VANES

BACKGROUND OF THE INVENTION

The present invention concerns cooling fans, such as fans driven by and for use in cooling an industrial or automotive engine. More particularly, certain aspects of the invention relate to a ring fan, while other features concern fan blade design.

In most industrial and automotive engine applications, an engine-driven cooling fan is utilized to blow air across a coolant radiator. Usually, the fan is driven through a belt-drive mechanism connected to the engine crankshaft.

A typical cooling fan includes a plurality of blades mounted to a central hub plate. The hub plate can be configured to provide a rotary connection to the belt drive mechanism, for example. The size and number of fan blades is determined by the cooling requirements for the particular application. For instance, a small automotive fan may only require four blades having a diameter of only 9". In larger applications, a greater number of blades are required. In one typical heavy-duty automotive application, nine blades are included in the fan design, the blades having an outer diameter of 704 mm.

In addition to the number and diameter of blades, the cooling capacity of a particular fan is also governed by the airflow volume that can be generated by the fan at its operating speed. This airflow volume is dependent upon the particular blade geometry, such as the blade area and curvature or profile, and the rotational speed of the fan.

As the cooling fan dimensions and airflow capacity increase, the loads experienced by the fan, and particularly the blades, also increase. In addition, higher rotational speeds and increased airflow through the fan can lead to de-pitching of the blades and significant noise problems. In order to address these problems to some degree, certain cooling fan designs incorporate a ring around the circumference of the fan. Specifically, the blade tips are attached to the ring, which provides stability to the blade tips. The ring also helps reduce vortex shedding at the blade tip, particularly when the ring is combined with a U-shaped shroud that follows the circumference of the ring.

The ring fan design, therefore, eliminates some of the structural difficulties encountered with prior unsupported cooling fan configurations. However, with the increased strength and improved vibration characteristics provided by the ring fan, the nominal operating conditions for these fans has been increased to again push the envelope of the ring fan's capability. Moreover, the mass inertia of the circumferential ring increases the centripetal force exerted on the blade-ring interface.

Consequently, a need has again developed for ways to improve cooling airflow capacity of ring fans, while at the same time increasing their strength. This need becomes particularly acute as the operational rotational speeds of the fan increase to meet the increasing cooling demands for large industrial and automotive engines.

SUMMARY OF THE INVENTION

To address these needs, the present invention contemplates an engine driven cooling fan for use in an engine cooling system, in which the fan is a ring-type fan. The fan includes a central hub and a plurality of fan blades projecting radially outwardly from the hub, each of the blades having a blade root connected to the hub and a blade tip at an opposite end thereof. Each of the blades further defines a leading edge at an inlet side of the fan and a trailing edge at an outlet side of the fan. The cooling fan also includes a circumferential ring connected to the blade tip of each of the plurality of fan blades.

In one aspect of the invention, the circumferential ring includes a radially outwardly flared rim at the outlet side of the fan. The flared rim defines a flared surface adapted to nest over the circumferential rim of another cooling fan when the fans are stacked for storage or shipment. The flared rim decreases the height of a stack of a predetermined number of cooling fans, and increases the stability of the stack.

In another feature of certain embodiments of the present invention, each of the fan blades includes a support vane attached to the rear face of the blade. In the preferred embodiment, the support vane has a first end originating adjacent the root and the leading edge of the blade, and an opposite second end terminating at the trailing edge of the blade between the blade root and the blade tip. Preferably, the support vane is curved between the first end and the second end to follow the curvature of the airflow path along the rear face of the fan blade. With this feature, the support vane does not disrupt the airflow through the cooling fan.

The support vane originates at the blade root to provide additional support and stiffness to the fan blade at a critical region of the blade. More specifically, the location and configuration of the support vane increases the first vibration mode stiffness of the cooling fan so that the excitation frequency of the first mode exceeds the maximum rotational speed of the fan.

In a most preferred embodiment, each of the plurality of fan blades defines a blade length between the root and the tip and the support vane terminates at a position on the trailing edge in the first half of the blade length. This positioning again minimizes the effect of the support vane on the airflow through the cooling fan.

In another aspect of the cooling fan of the present invention, a circumferential support ring is provided at the central hub adjacent the blade root. With this feature, the support vane is attached to the support ring so that the ring adds support and stiffness to the support vane. Most preferably, the cooling fan further includes a vane support superstructure connected between the support ring and the support. This superstructure can include an arrangement of ribs connected between the ring and vane arranged to react the aerodynamic loads experienced by the support vane when the fan is operating at speed. This superstructure can include an angled rib projecting substantially perpendicularly from the support vane at a position substantially in the middle of the support vane. Since the vane is curved to follow the airflow path, the perpendicular rib will project at an angle relative to the blade root and support ring. Additional radial ribs can be provided closer to the leading edge of the blade.

In other embodiments, the cooling fan can also include a ring support superstructure connected between the support ring and the central hub. This ring superstructure provides support for the ring to assist it in reacting the loads applied to the support vane. Preferably, the ring superstructure includes an arrangement of ribs that correspond to the ribs of the vane support superstructure.

In another feature of the invention, the circumferential outer ring and the blade tip define a blend region therebetween. More specifically, this blend region is situated between the blade tip edge adjacent the trailing edge, and the flared rim of the circumferential ring. This blend region eliminates stress risers that ordinarily exist at the junction between the outer ring and the fan blades, which substantially reduces the risk of blade/ring separation. In addition, the inventive blend region can be accomplished in a typical molding process using a two-piece mold, without the need for inserts.

In yet another feature of the invention, each of the fan blades has a unique airfoil geometry that optimizes airflow characteristics while preserving blade strength and stiffness. Thus, one feature of the invention contemplates a blade geometry in which the blade camber varies along the radial length of the blade. More specifically, the camber has a minimum value at a position approximately one-sixth (1/6) of the radial length from the blade root. Thus, the camber decreases from the blade root to this position, and increases thereafter to the trailing edge of the blade. In alternative embodiments, the blade geometry also includes a chord angle that varies along the radial length of the blade, having a maximum value at the same position along the radial length. Similarly, the blade can define a variable chord-pitch-ratio (cpr) that has a maximum value at this same position. The resulting blade has improved airflow characteristics over prior known fan blades.

It is one object of the invention to provide a strength and performance optimized ring fan for an engine cooling system.

Another object resides in features that increase the stackability of the subject fan with other fans.

One benefit of the invention is that it provides a ring fan having increased first vibration mode stiffness. Another benefit is that this improved stiffness is accomplished without significant impact on the airflow characteristics of the fan.

Other objects and benefits of the present invention in its various embodiments will be appreciated upon consideration of the following written description and accompanying figures.

DESCRIPTION OF THE PREFERRED EMBODIMENTS

Figure 1:
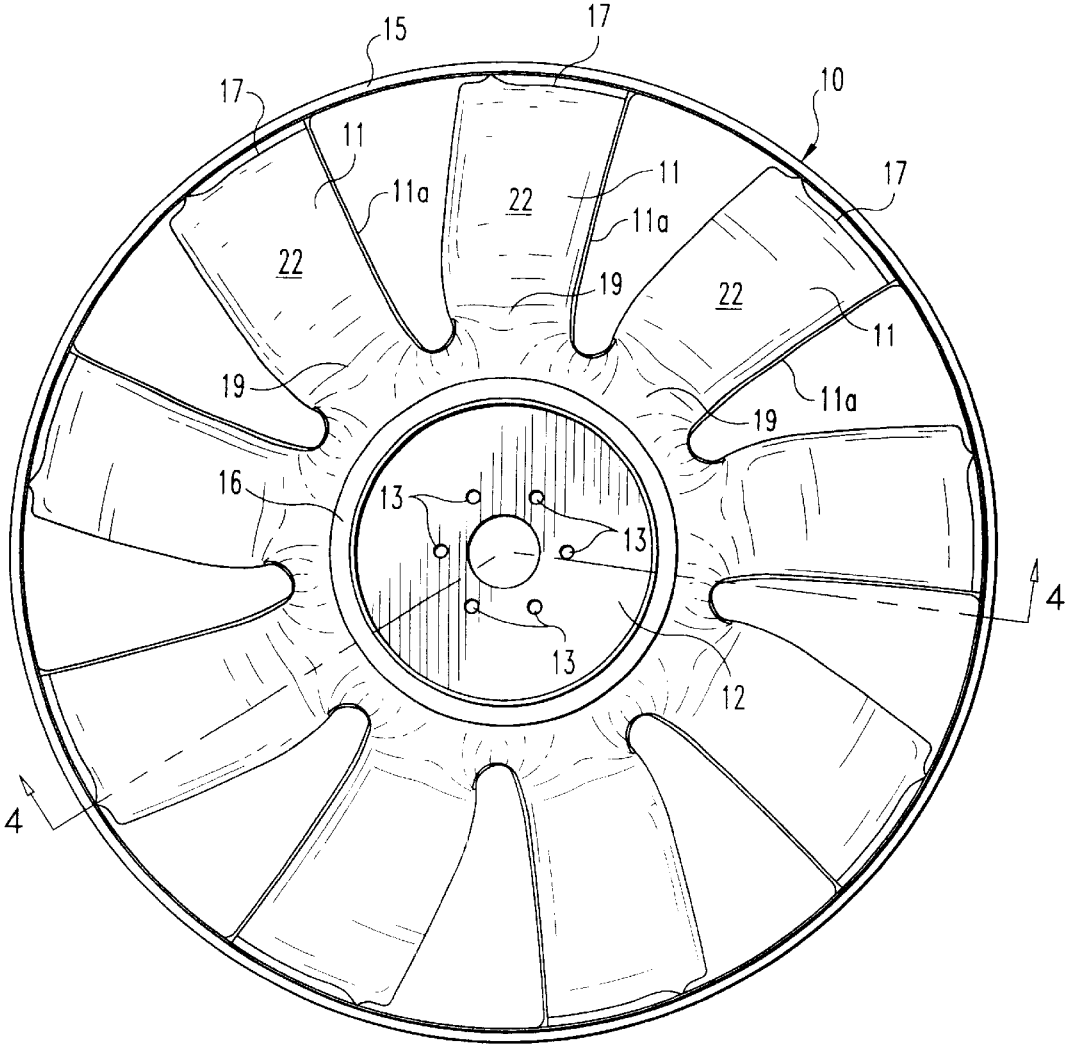
FIG. 1 is a top elevational view of a ring fan in accordance with one embodiment of the present invention.

For the purposes of promoting an understanding of the principles of the invention, reference will now be made to the embodiments illustrated in the drawings and specific language will be used to describe the same. It will nevertheless be understood that no limitation of the scope of the invention is thereby intended. The inventions includes any alterations and further modifications in the illustrated devices and described methods and further applications of the principles of the invention which would normally occur to one skilled in the art to which the invention relates.

In one embodiment of the invention, a ring fan 10, as depicted in FIG. 1, includes a number of blades 11 mounted to a central hub plate 12. The hub plate can include a mounting bolt ring 13 configured to mount the fan to a fan drive assembly of known design. The fan 10 further includes an outer ring 15 fixed to the blade tips 17 of each of the fan blades 11. The ring fan 10 of FIG. 1, as thus far described, can be constructed in a known manner. For instance the outer ring 15 and blades 11 can be formed of a high strength moldable polymer material that is preferably injection molded about a metallic hub plate 12, in a conventional known process. In this process, typically the hub plate 12 will be molded within an inner ring 16 formed at the root 19 of each of the blades 11.

Each of the blades 11 includes a front face 22 that is at the effective inlet to the ring fan 10. Likewise, each blade includes an opposite rear face 25 (see FIG. 2) on the backside of the ring fan. In the preferred embodiment, nine blades 11 can be provided, each having a substantially uniform thickness from the blade root 19 to the blade tip 17. In an alternative embodiment, each of the blades 11 can vary in thickness from the leading edge 11*a* to the trailing edge 11*b* of the blade. Each blade 11 preferably follows an air foil-type configuration adapted to provide maximum airflow when the ring fan 10 is operated within its standard rotational speed operational range.

Figure 2:
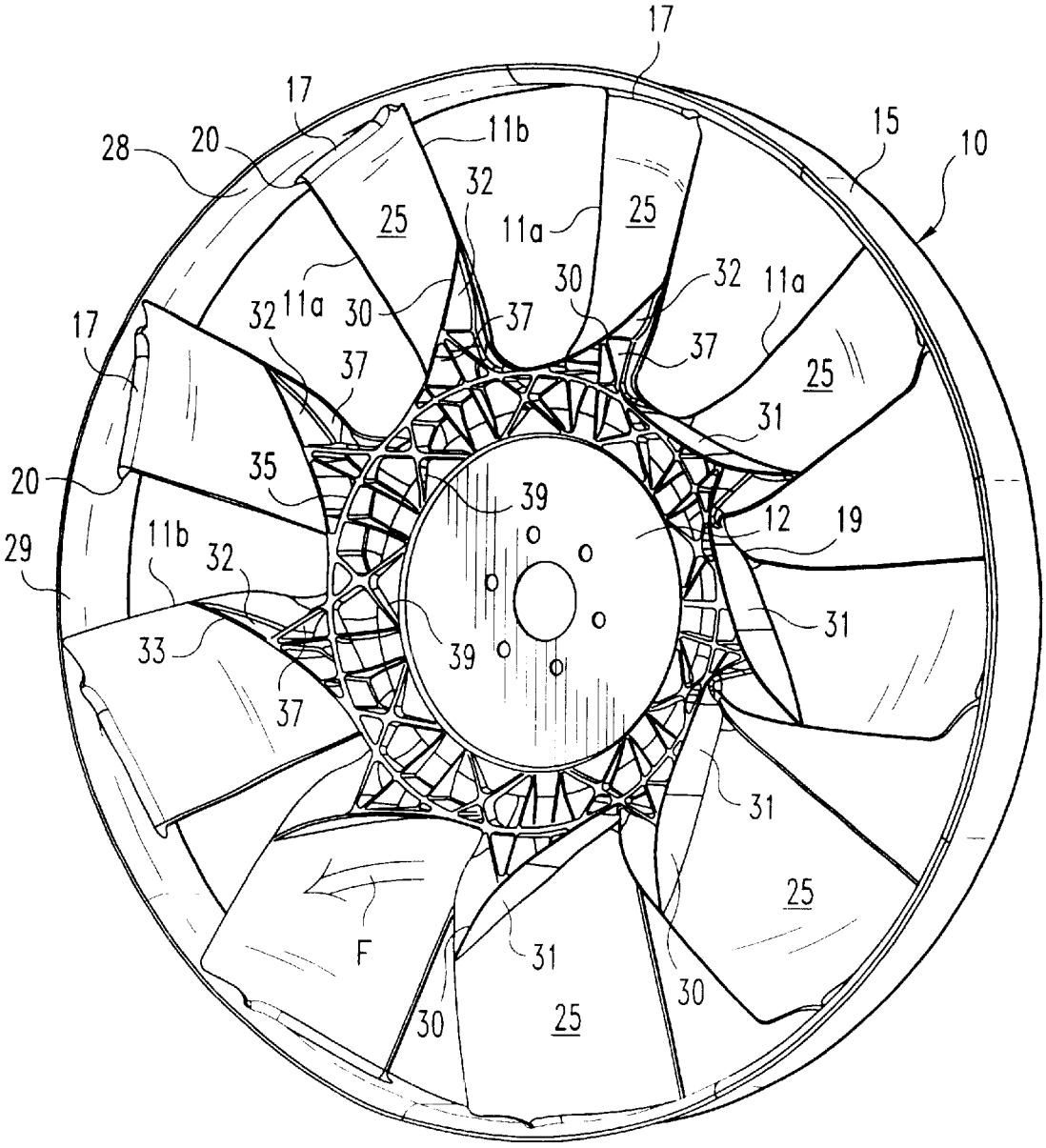
FIG. 2 is a bottom perspective view of the ring fan depicted in FIG. 1.
Figure 3:
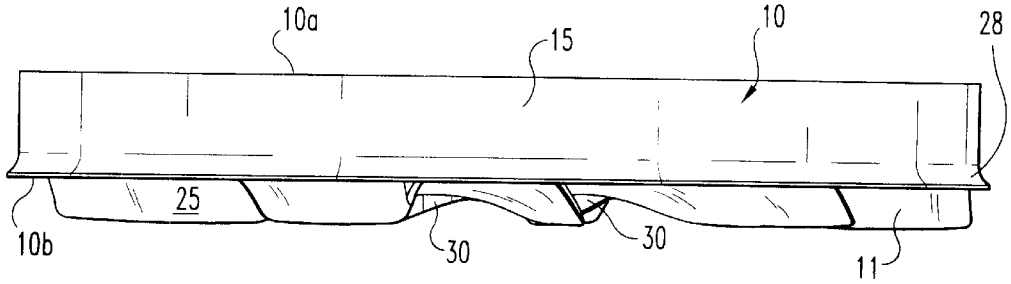
FIG. 3 is a side elevational view of the ring fan depicted in FIGS. 1 and 2.

In referring to FIG. 2, it can be seen that the outer ring 15 of the fan 10 includes a flared rim 28, disposed generally at the output face of the fan. The flared rim defines a radially outwardly flared surface 29 that follows a gradual curvature away from the tips 17 of each of the blades 11. The fan defines an inlet side 10*a* at the leading edges 11*a* of the fan blades, and an opposite outlet side 10*b* at the trailing edges 11*b*. The flared rim 28 of the outer ring is disposed at the outlet side 10*b* of the fan.

Figure 5:
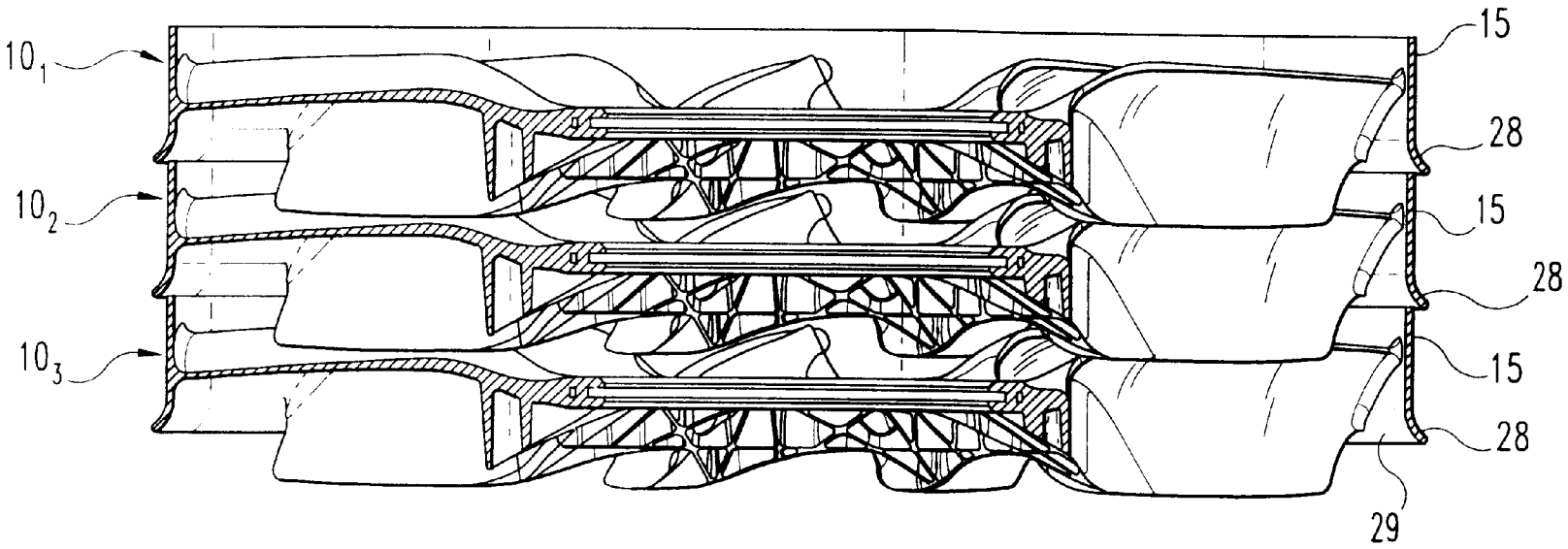
FIG. 5 is a side, partial, cross-sectional view of a number of ring fans, such as the fan illustrated in FIG. 1, shown in a stacked arrangement.

One benefit provided by the flared rim 28 of the outer ring 15 is depicted in FIG. 5. More specifically, FIG. 5 depicts three ring fans according to the present invention, fans $\mathbf{10}_1$, $\mathbf{10}_2$ and $\mathbf{10}_3$, shown in a stacked arrangement. Typically, when cooling fans are manufactured, they are stacked for storage and/or shipment to an end user. It is frequently important to optimize the number of fans stored or shipped, which can require increasing the height of the stacked fans and/or increasing the number of fans that can be contained within a particular height envelope. The flared rim 28 of the present invention accommodates both beneficial objectives. Specifically, the flared rim 28 provides a nesting surface, particularly at the flared surface 29, which can rest on the outer ring 15 of a lower adjacent fan. This aspect reduces the overall height of a pre-determined number of fans stacked on top of each other, since each fan is nested slightly within the next adjacent fan. Moreover, the flared surface 29 of the rim 28 helps increase the stability of each stack of fans, making the stack resistant to shifting or toppling.

Referring back to FIG. 2, another important feature of the present embodiment of the invention can be discerned. Specifically, each of the blades 11 can include a support vane 30 defined on the rear face 25. Preferably, the support vane 30 has about the same thickness as each of the blades 11, and is configured to be molded with the remainder of the fan 10. In accordance with the present invention, the support vanes 30 are adjacent the root 19 of each blade 11. Under certain operating conditions, namely at high rotational speeds and high air flow rates, the ring fan 10 can be excited at its first vibration mode (i.e.—a drum-like oscillation). The support vane 30 at the blade root 19 of each blade increases the first mode stiffness, which consequently increases the excitation speed for this vibration mode beyond the normal operating speed range of the ring fan 10.

While the addition of the support vane 30 is important to improve the vibration characteristics of the ring fan 10, it can present a disruption in the airflow across the rear face 25 of each blade 11. Thus, in a further aspect of the invention, each support 30 is curved from the leading edge 11*a* to the trailing edge 11*b* of the blade. Specifically, the vane follows the curvature of a characteristic airflow path designated by the arrow F in FIG. 2. Most preferably, the support vane 30 originates directly adjacent the blade root 19 and follows the air flow curvature F to the trailing edge 11*b* of the blade, terminating at a location approximately one-third of the radial length of the blade.

In the illustrated embodiment, the airflow curvature F is common to mixed flow cooling fans. In is contemplated that other flow vectors will arise with other types of fans, such as radial and axial flow fans, and that the curvature of the support vane 30 can be modified accordingly.

Figure 4:
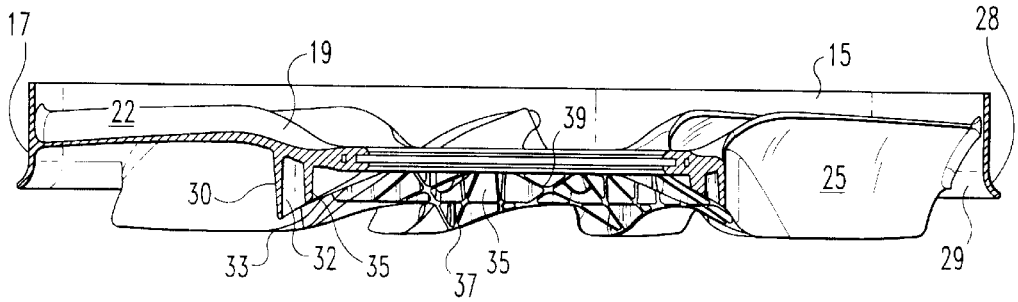
FIG. 4 is a side cross-sectional view of the ring fan depicted in FIG. 1, taken along line 4—4 as viewed in the direction of the arrows.

In a further aspect of the support vanes 30, the vanes originate from an interior support ring 35 that is in the form of a thin-walled ring around the inner molded ring 16 of the fan 10. This support ring 35 can have sufficient height projecting from the rear face of the fan so that the upper edge of the support ring 35 projects slightly beyond or outside the plane of the flared rim 28 of the fan, as best seen in FIG. 4. Preferably, though, the support ring does not project so high from the hub of the fan as to interfere with mounting the fan to its drive mechanism.

In a specific embodiment, the support vane 30 thus originates at the support ring 35 and has a height equal to the support ring at the blade root 19. Because the blade chord curves along its radial length, the height of the support vane 30 decreases as the vane traverses from the blade root to its terminus at the trailing edge 11*b* of the blade. Most preferably, the support vane is sculpted so that the trailing edge 33 of the vane does not extend outside a plane formed by the trailing edges of the fan blades 11.

The support vane 30 and the accompanying ring 35 operate to increase the frequency and reduce the severity of the first mode of vibration response of ring fan 10. Nevertheless, further strengthening of these features is desirable to maintain the flow guide surface 31 of each of the support vanes 30. Consequently, according to a further aspect of the preferred embodiment of the invention, a vane support superstructure 37 is disposed between the support ring 35 and the back support surface 32 of each of vane 30. In addition, the support ring 35 itself is provided with a ring support superstructure 39 radially inboard of the ring and integrated into the inner ring 16 of the molded fan 10.

Figure 6:
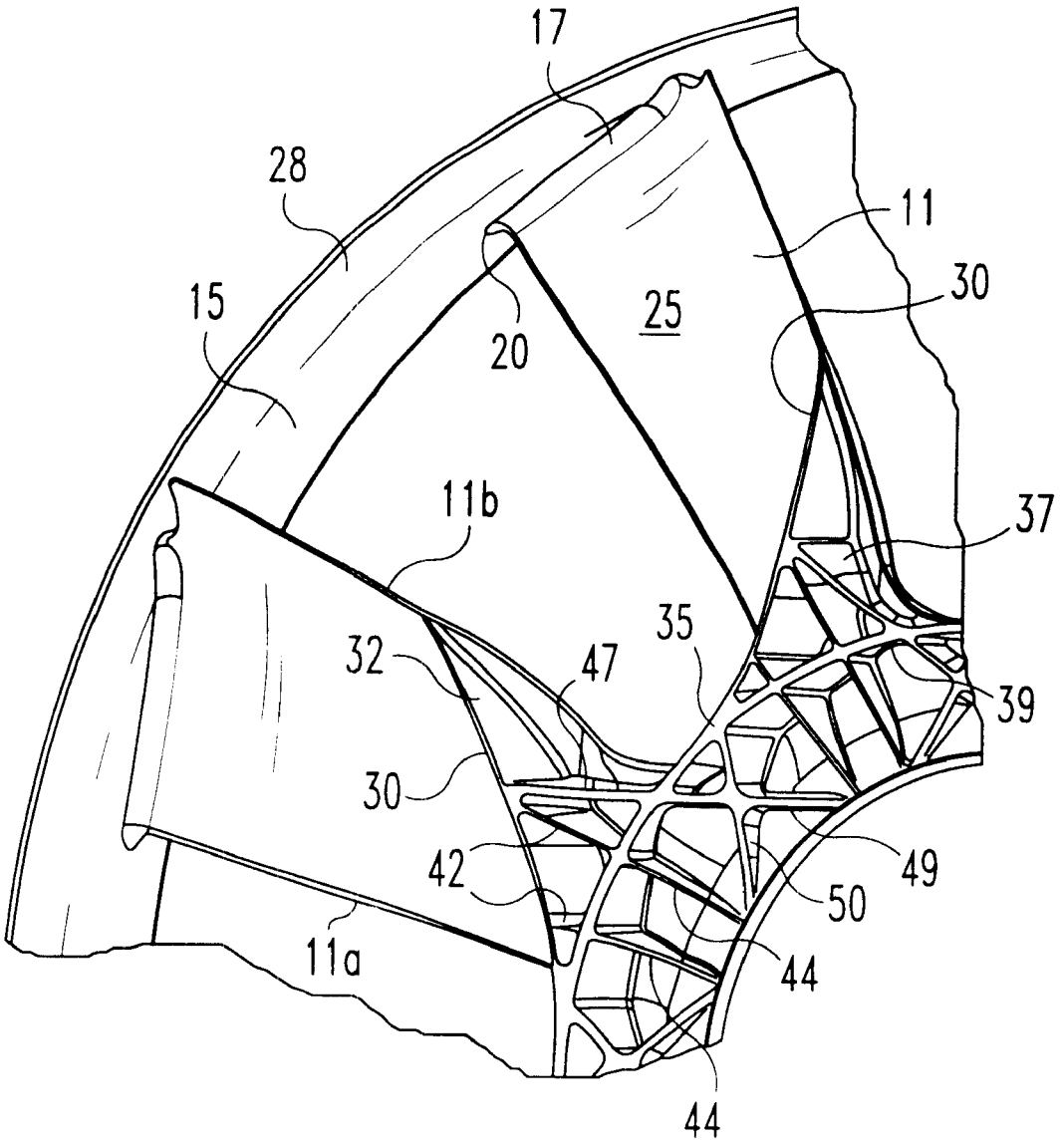
FIG. 6 is an enlarged perspective view of a portion of the ring fan of the present invention, as illustrated in FIG. 2.

Details of the vane support superstructure 37 and ring support superstructure 39 are depicted most clearly in FIG. 6. In the most preferred embodiment, the vane support superstructure 37 includes a pair of parallel radial support ribs 42 that project radially outwardly from the support ring 35 to contact the support surface 32. These parallel radial ribs 42 are disposed adjacent the leading edge 11*a* of each blade. In addition, the vane support superstructure 37 includes an angled vane support rib 47 that is generally at the mid-point of the support vane 30. The angled rib 47 is oriented to directly counteract the aerodynamic force exerted on the support vane 30 at its mid-chord position.

In order to prevent deflection or vibration of the support ring 35, the ring support superstructure 39 includes a pair of radial ring support ribs 44 and an angled ring support rib 49. The radial ribs 44 are aligned with the radial vane support ribs 42 to react any loads transmitted through the vane supports directly into the inner ring 16 and hub plate 12 of the fan. Likewise, the angled ring support rib 49 is aligned with the angled vane support rib 47, again to directly react the aerodynamic loads acting on the support vane 30 in that direction.

Finally, in accordance with a specific embodiment of the invention, each of the angled ring support ribs 49 includes a substantially perpendicularly oriented brace rib 50 that spans between the inner ring 16 and hub plate 12 to the support ring 35. With this configuration, the vane support superstructure 37 and ring support superstructure 39 provide adequate strength and stiffness to the support vane 30. This additional support allows the support vane to provide adequate strength and stiffness to each of the fan blades 11. This combination of strengthening features allows the ring fan 10 to operate at its highest possible speed and cooling airflow rate.

Figure 7:
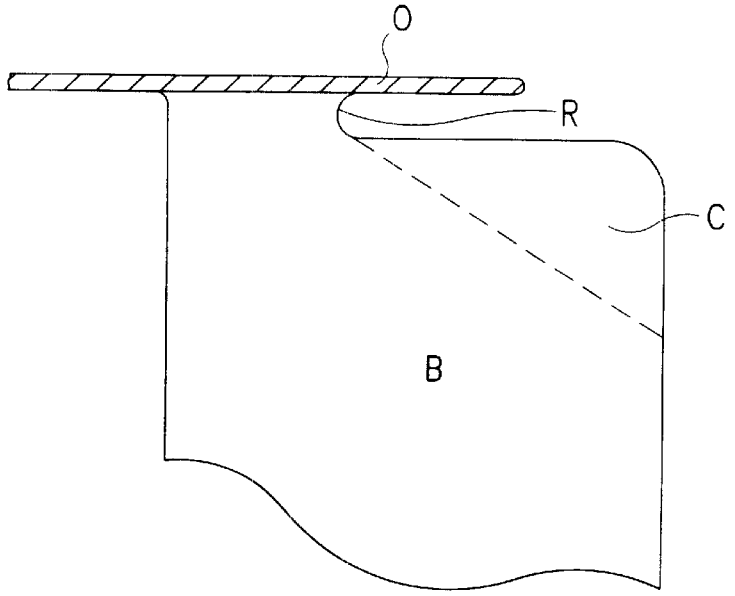
Fig. 7 (PRIOR ART)
FIG. 7 is an enlarged partial view of a blade-ring interface for a prior art cooling fan configuration.
Figure 8:
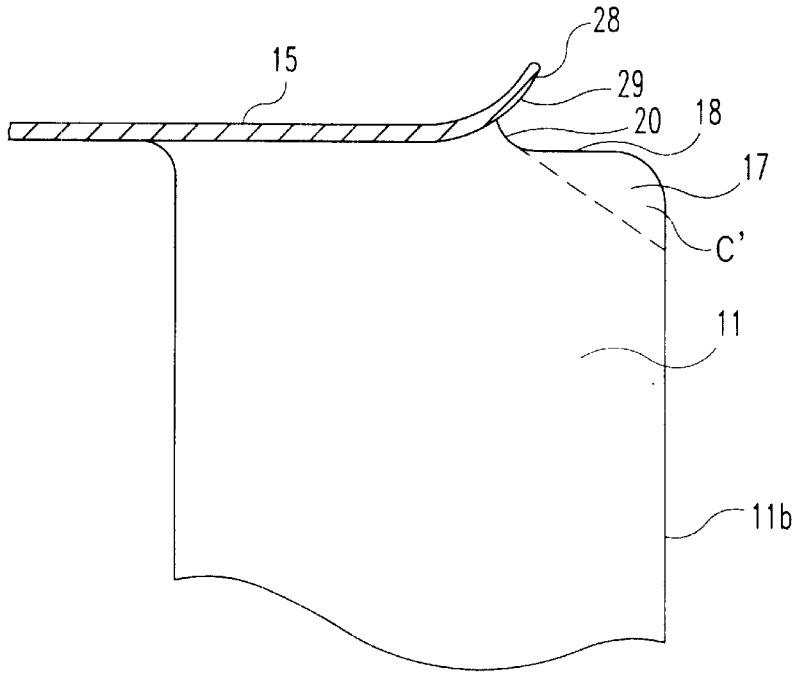
FIG. 8 is an enlarged partial view of a blade-ring interface according to a preferred embodiment of the present invention.

A further feature of the invention is depicted best in FIGS. 7 and 8. A prior art blade B of a known ring fan is illustrated in FIG. 7, in which the blade tip is attached to a circumferential ring O. In this typical prior construction, the blade tip attachment is at a radiused recess R. This recess is substantially inboard along the outer ring O, leaving a significant length of the blade tip unsupported. This unsupported length creates an area C that is subject to tip deflection and even fracture during normal usage of the prior fan blade. Moreover, and most significantly, the blade/ring interface can experience severe stress risers at the radius of the recess R. These stress risers can eventual result in separation of the blade tip from the ring, which then usually leads to a failure of the cooling fan.

In order to address this critical problem, one embodiment of the present invention contemplates a blend region 20 between the flared rim 28 of the outer ring 15 and the tip 17 of each blade 11, as shown in FIG. 8. In particular, this blend region 20 is between the tip edge 18 of the blade and the flared surface 29 of the outer ring 15.

As depicted in FIG. 8, the addition of the blend region 20 substantially reduces the unsupported length of the blade tip 17. This reduction in turn greatly reduces the area C' that can deflect during normal usage. In addition, should the blade fracture at that area C', the impact of the lost material on the performance of the blade and fan is minimized. A further benefit is that the blade width can be increased for certain fan designs, so that the trailing edge 11*b* of the blade extends farther beyond the flared rim 28 than depicted in the specific embodiment of FIG. 8.

The blend region 20 according to the present invention also accommodates standard molding techniques. According to conventional fan production processes, a two piece mold is used to injection mold the polymer fan about the central metallic hub. Many features of fan design are dictated by the parting directions of the two mold halves and the desire to eliminate the use of movable mold inserts. The prior art blade configuration depicted in FIG. 7 is illustrative of a blade design that can be easily accomplished without mold inserts.

The blade and blend region of the present invention involves the addition of a slight amount of material to the blade tip from the prior blade designs. This added material is applied at the convex side of the blade at the blend region 20, which accommodates the parting direction of a two-piece mold. Thus, this inventive blade-strengthening feature can be accomplished without increasing the complexity and cost of the molding process.

The present invention also contemplates a unique blade geometry that enhances the air flow output of the fan 10, while still maintaining the strength characteristics created by the other inventive features. More specifically, one aspect of the invention contemplates a blade constructed according to the geometry parameters illustrated in the graphs of FIGS. 10*a*–10*c*. This blade geometry is presented in terms of standard design parameters—i.e., solidity, chord angle and camber as a function of radial distance from the blade root. Solidity is a relative measure of the blade area, and is sometimes referred to as chord-pitch-ratio (cpr). This parameter is a function of blade spacing at the particular radial location. Chord angle is the angle of the blade chord relative to the plane of rotation of the fan. Camber is a measure of the curvature of the blade, and more specifically the percent ratio of the camber height to the chord length at the particular radial location.

Figure 10A:
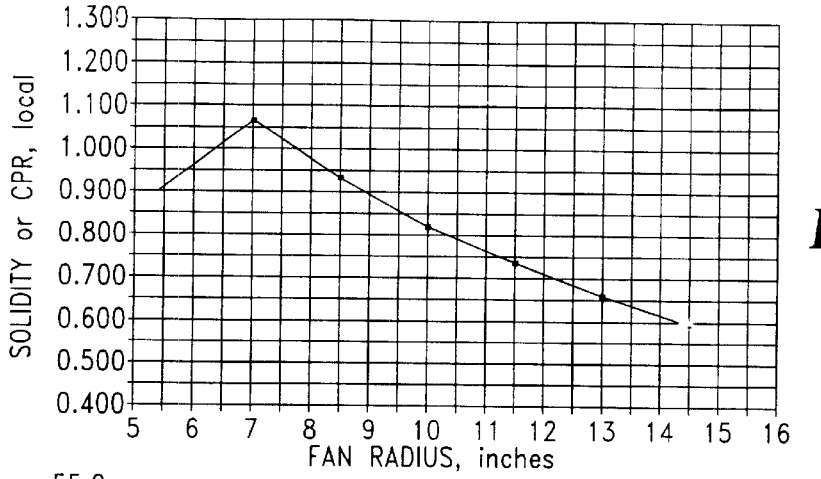
FIGS. 10*a*–10*c* are graphs of blade geometry parameters for cooling fan blades according to one embodiment of the present invention.
Figure 10B:
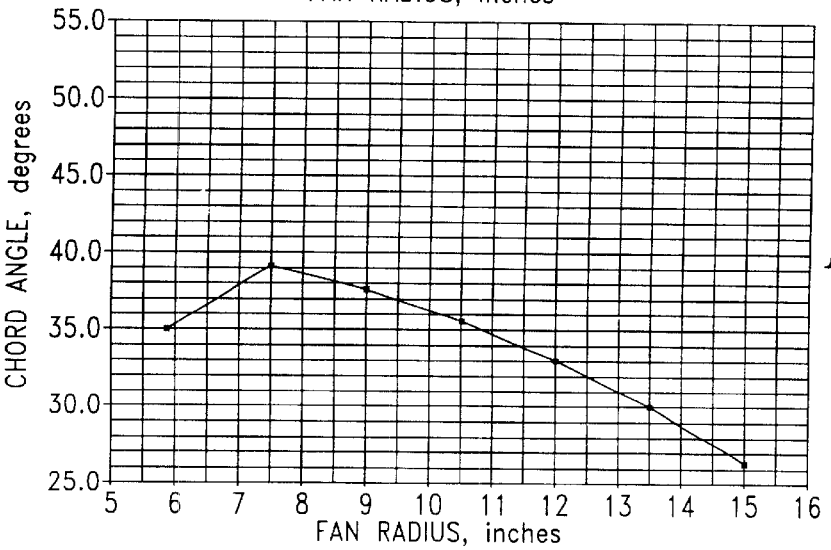
Figure 10C:
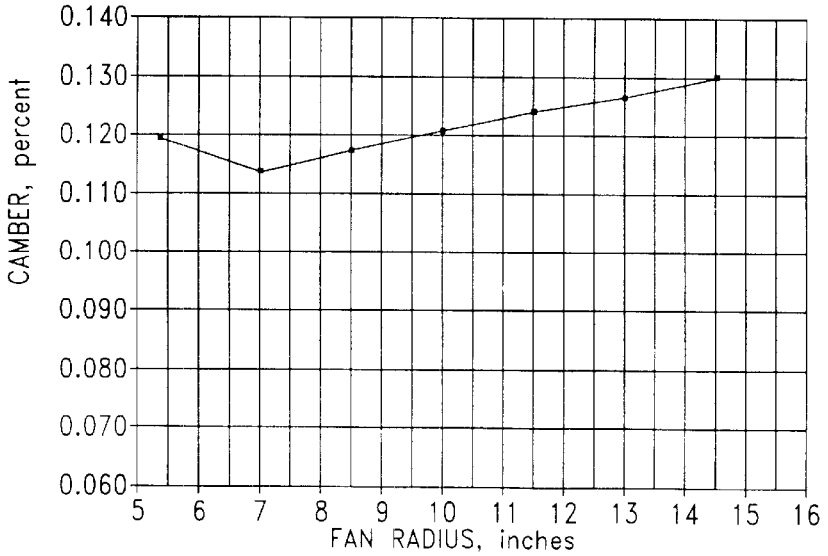

As depicted in the graphs of FIGS. 10*a*–10*c*, the peak values for solidity and chord angle, and the minimum value for camber, all occur at the same fan radius. In the preferred embodiment, this radius is at about one-sixth the overall blade length. The solidity and chord angle values gradually decrease from the peak values, while the camber parameter gradually increases. In accordance with the present invention, the solidity and chord angle values are significantly greater at their respective peaks than the corresponding values at either the blade root or tip. For example, the blade solidity parameter has a value of about 0.90 at the root and 0.60 at the tip, and a peak value of about 1.05. The chord angle increases from 36° at the blade root to a peak value of 40°, and eventually decreasing to about 27.5° at the blade tip. For both parameters, the peak value is at least ten percent greater than the value at the blade root. Finally, the camber value begins at a value of 0.12 at the root and finishes at 0.13 at the tip, with a minimum value of about 0.113.

Figure 9A:
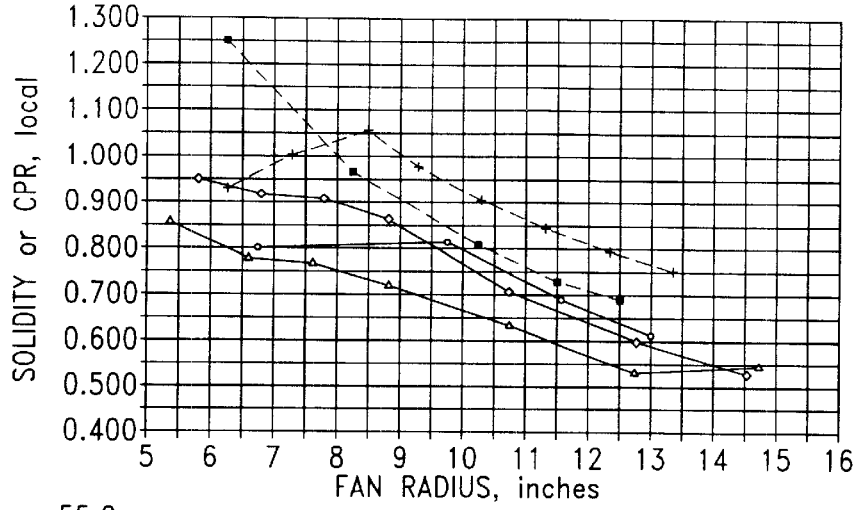
FIGS. 9*a*–9*c* are graphs of blade geometry parameters for prior art cooling fan blades.
Figure 9B:
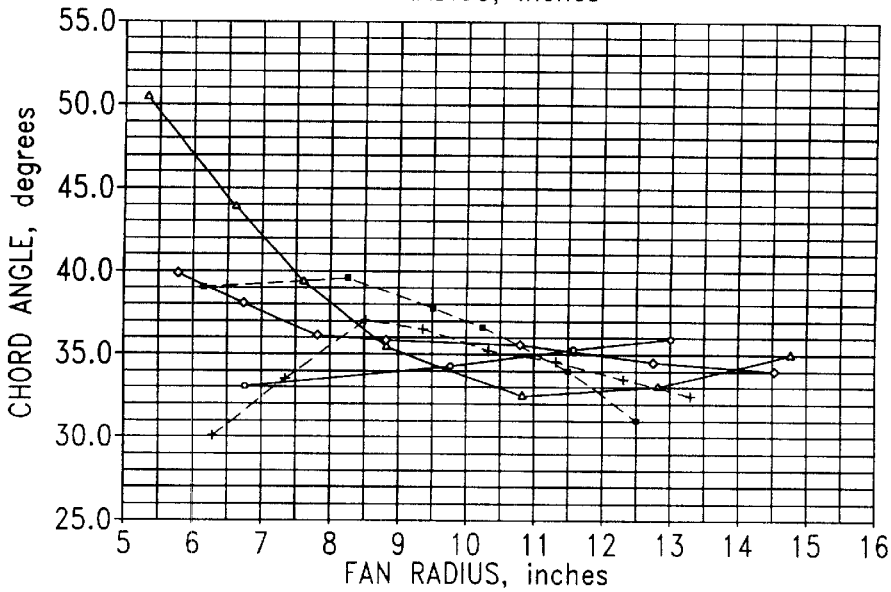
Figure 9C:
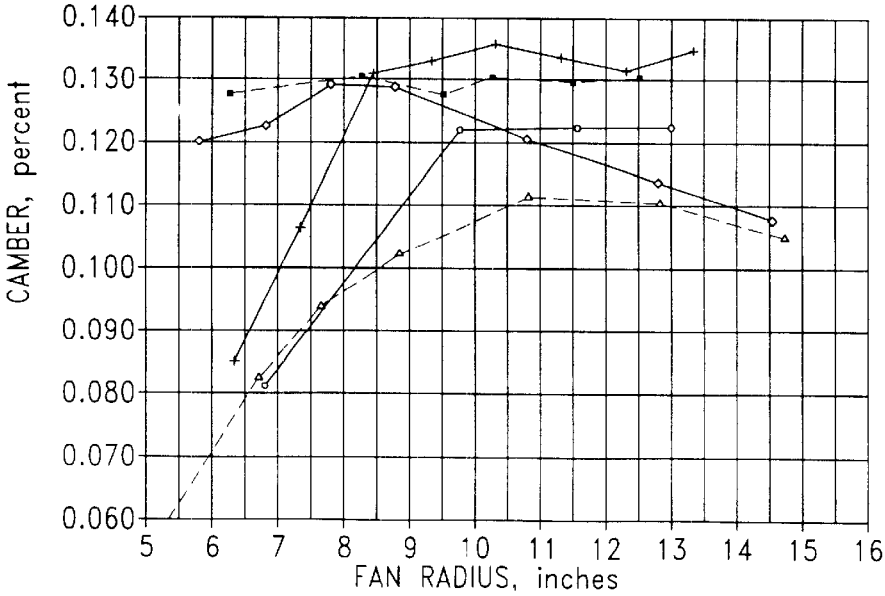

The novelty of the blade geometry for the present invention can be appreciated in comparison to the prior art blade designs depicted in the graphs of FIGS. 9*a*–9*c*. With one exception, none of the prior blade designs exhibited a substantial peak value for solidity or chord angle. Most significantly, none of the prior designs contemplate the camber curve of the present invention, namely a curve that decreases from the blade root to a minimum value in the first one-sixth of the blade length, and then increases again to the blade tip.

The blade geometry according to the present invention optimizes cooling airflow generated by the rotating fan blades, while providing increased strength, particularly at the blade root, over prior ring fan blade designs. It is understood that this blade geometry can be used on a wide variety of cooling fans. In the specific illustrated embodiment, the blade geometry is applied to a mixed flow ring fan. The same geometry can be used for ringless fans as well as axial and radial flow fans.

While the invention has been illustrated and described in detail in the drawings and foregoing description, the same is to be considered as illustrative and not restrictive in character. It should be understood that only the preferred embodiments have been shown and described and that all changes and modifications that come within the spirit of the invention are desired to be protected.

What is claimed is:

1. An engine driven cooling fan (10) for use in an engine cooling system, the fan (10) comprising:

a central hub (12);

a plurality of fan blades (11) projecting radially outwardly from the hub (12), each of the blades (11) having a blade root (19) connected to the hub and a blade tip (17) at an opposite end thereof, and each of the blades (11) defining a leading edge (11*a*) at an inlet side (10*a*) of the fan and a trailing edge (11*b*) at an outlet side (10*b*) of the fan, the blades (11) further defining a front face (22) directed toward the inlet side(10*a*) of the fan (10) and an opposite rear face (25) directed toward the outlet side (10*b*) of the fan (10); and each of said blades (11) including a support vane (30) attached to said rear face (25) thereof, said support vane (30) having a first end originating adjacent said blade root (19) and said leading edge (11*a*), and an opposite second end terminating at said trailing edge (11*b*) between said blade root (19) and said blade tip (17).

2. The cooling fan (10) according to claim 1, wherein:

the support vane (30) is curved between said first end and said second end.

3. The cooling fan (10) according to claim 2, wherein said support vane (30) is curved to correspond to the airflow path (F) across said rear face (25) of each of said fan blades (11).

4. The cooling fan (10) according to claim 1, wherein:

each of said plurality of fan blades (11) defines a blade length between said root (19) and said tip (17); and said support vane (30) terminates at a position on said trailing edge (11*b*) in said first half of said blade length from said blade root (19).

5. An engine driven cooling fan (10) for use in an engine cooling system, the fan (10) comprising:

a central hub (12);

a plurality of fan blades (11) projecting radially outwardly from the hub (12), each of the blades (11) having a blade root (19) connected to the hub and a blade tip (17) at an opposite end thereof, and each of t he blades (11) defining a leading edge (11*a*) at an inlet side (10*a*) of the fan and a trailing edge (11*b*) at an outlet side (10*b*) of the fan, the blades (11) further defining a front face (22) directed toward the inlet side(10*a*) of the fan (10) and an opposite rear face (25) directed toward the outlet side (10*b*) of the fan (10);

each of said blades (11) including a support vane (30) attached to said rear face (25) thereof, said support vane (30) having a first end originating adjacent said blade root (19) and said leading edge (11*a*), and an opposite second end terminating at said trailing edge (11*b*) between said blade root (19) and said blade tip (17); and a circumferential support ring (35) attached to said hub (12) adjacent said blade root (19) of said plurality of fan blades (11), wherein said first end of said support vane (30) is attached to said support ring (35).

6. The cooling fan (10) according to claim 5, further comprising a vane support superstructure (37) connected between said support ring (35) and said support vane (30) between said first end and said second end thereof.

7. The cooling fan (10) according to claim 6, wherein:

said support vane (30) is curved between said first end and said second end.

8. The cooling fan (10) according to claim 7, wherein said vane support superstructure (37) includes an angled rib (47) projecting substantially perpendicularly from said curved support vane (30) at a position in said middle of said support vane (30).

9. The cooling fan (10) according to claim 6, further comprising a ring support superstructure (39) connected between said support ring (35) and said central hub (12).

10. The cooling fan (10) according to claim 9, wherein:

said vane support superstructure (37) includes an arrangement of radially oriented and angled ribs (42, 47) connected between said support vane (30) and said support ring (35); and said ring support superstructure (39) includes an arrangement of ribs (44, 49) aligned with corresponding ones of said radially oriented and angled ribs (42, 47) of said vane support superstructure (37).

11. The cooling fan (10) according to claim 5, wherein:

said support ring (35) has a height from said central hub (12) defining a plane; and said support vane (30) defines a height from said back face (25) of each of said fan blades (11) adapted to maintain said support vane (30) at said plane.

12. An engine driven cooling fan (10) for use in an engine cooling system, the fan (10) comprising:

a central hub (12);

a plurality of fan blades (11) projecting radially outwardly from said hub (12), each of said blades (11) having a blade root (19) connected to said hub (12) and a blade tip (17) at an opposite end thereof, said blade tip (17) having a tip edge (18), and each of said blades defining a leading edge (11*a*) at an inlet side (10*a*) of the fan (10) and a trailing edge (11*b*) at an outlet side (10*b*) of the fan (10); and a circumferential ring (15) defining a radially outwardly flared rim (28) at said outlet side of the fan, wherein said circumferential ring (15) is connected to a substantial portion of said tip edge (18)of each of said plurality of fan blades (11), from said leading edge (11*a*) of said blades (11) to a blend region (20) proximate said trailing edge (11*b*), said blend region (20) connected to said flared rim (28) of said circumferential ring (15).

13. An engine driven cooling fan (10) for use in an engine cooling system, the fan (10) comprising:

a central hub (12); and a plurality of fan blades (11) projecting radially outwardly from said hub (12), each of said blades (11) having a blade root (19) connected to said hub (12) and a blade tip (17) at an opposite end thereof and defining a radial length between said root (19) and said tip (17), wherein each of said fan blades (11) defines a camber that varies along the radial length of said blade (11), said camber having a minimum value at a position approximately one-sixth (⅙) of the radial length from said blade root (19).

14. The cooling fan (10) according to claim 13, wherein each of said fan blades (11) defines a chord angle that varies along the radial length of said blade (11), said chord angle having a maximum value at the position along the radial length.

15. The cooling fan (10) according to claim 13, wherein each of said fan blades (11) defines a chord-pitch-ratio (cpr) that varies along the radial length of said blade (11), said cpr having a maximum value at the position along the radial length.

16. The cooling fan (10) according to claim 13, further comprising a circumferential ring (15) connected to said blade tip (17) of each of said plurality of fan blades (11).

17. An engine driven cooling fan (10) for use in an engine cooling system, the fan (10) comprising:

a central hub (12);

a plurality of fan blades (11) projecting radially outwardly from said hub (12), each of said blades (11) having a blade root (19) connected to said hub (12) and a blade tip (17) at an opposite end thereof, and each of said blades (11) defining a leading edge (11*a*) at an inlet side (10*a*) of the fan and a trailing edge (11*b*) at an outlet side (10*b*) of the fan; and a circumferential ring (15) connected to said blade tip (17) of each of said plurality of fan blades (11), said circumferential ring (15) defining a radially outwardly flared rim (28) at said outlet side (10*b*) of the fan (10) configured for contact with said circumferential ring (15) of another cooling fan (10) stacked thereon.

* * * * *